US005859413A

United States Patent [19]

Kim et al.

[11] Patent Number: 5,859,413

[45] Date of Patent: Jan. 12, 1999

[54] METHOD FOR CONTROLLING A MICROWAVE OVEN TO PREVENT OVERCOOKING OF SMALL FOOD PORTIONS

[75] Inventors: Kwang-Keun Kim; Seok-Weon Hong; Kwang-Seok Kang, all of Suwon, Rep. of Korea

[73] Assignee: Samsung Electronics Co., Ltd., Suwon, Rep. of Korea

[21] Appl. No.: 803,131

[22] Filed: Feb. 21, 1997

[30] Foreign Application Priority Data

Feb. 23, 1996 [KR] Rep. of Korea ..... 1996 4362

[51] Int. Cl.[6] ..... H05B 6/68

[52] U.S. Cl. ..... 219/708; 219/518; 219/719; 99/325

[58] Field of Search ..... 219/708, 705, 219/719, 518; 99/325

[56] References Cited

U.S. PATENT DOCUMENTS

| | | | |
|---|---|---|---|
| 4,590,350 | 5/1986 | Ueda | 219/708 |
| 4,615,404 | 10/1986 | Morino et al. | 219/708 |
| 5,408,075 | 4/1995 | De Matteis et al. | 219/708 |
| 5,672,291 | 9/1997 | Han | 219/753 |

FOREIGN PATENT DOCUMENTS

| | | | |
|---|---|---|---|
| 63-254326 | 10/1988 | Japan . | |
| 03282124 | 12/1991 | Japan . | |
| 5-187643 | 7/1993 | Japan | 219/708 |
| 8/320123 | 12/1996 | Japan . | |

*Primary Examiner*—Philip H. Leung
*Attorney, Agent, or Firm*—Burns, Doane, Swecker & Mathis, L.L.P.

[57] ABSTRACT

A microwave oven prevents an overcooking of small food portions. The oven includes a weight sensing device for sensing the weight of food to be cooked. If the sensed food weight is greater than a reference weight, then a cooking time is set, e.g., manually or automatically on the basis of a selected cooking mode and/or the sensed food weight. If the sensed food weight is less than the reference weight, then a maximum cooking time is automatically set which is the same, regardless of the amount by which the food weight is less than the reference weight. The cooking time cannot exceed that maximum time period, thereby ensuring that the food will not be overcooked.

4 Claims, 5 Drawing Sheets

METHOD FOR CONTROLLING A MICROWAVE OVEN TO PREVENT OVERCOOKING OF SMALL FOOD PORTIONS

BACKGROUND OF THE INVENTION

1. Field of the Invention

The present invention generally relates to a method for controlling a cooking operation of a microwave oven.

2. Description of the Prior Art

The following description relates to the prior art. Firstly, Japanese Laid-open Patent No. Sho 63-254326 published Oct. 21, 1988 discloses an apparatus for displaying an error when a controller senses that no food has been placed on a tray in a cooking chamber. This apparatus stores a tray weight in the controller, and thus any sensed weight that is above the stored tray weight when the tray acts upon a weight sensing mechanism represents the weight of the food. Also, if the rotary tray does not properly act upon the weight sensing mechanism, the microcomputer displays an error.

U.S. Pat. No. 4,615,405 and Japanese Laid-Open Patent Publication 96-320123 disclose microwave ovens having a weight sensor for sensing the weight of food on a tray of a microwave oven. The U.S. patent discloses that the cooking time period is calculated as a function of the sensed food weight.

Japanese Utility Model Publication (unexamined) No. 03282124 (published Dec. 12, 1991 discloses a microwave oven that includes a spin chuck table, a rotary tray located on the spin chuck table, and a tray elevating device which raises the tray to a prescribed height. When the tray elevating device goes into action, the tray is elevated after being disjoined from the spin chuck table. The tray then rotates, and microwaves generated by a magnetron are uniformly transferred, even to the bottom of the tray.

A conventional microwave oven depicted in FIG. 5 includes: a metallic cabinet 10; a cooking chamber 11; a magnetron (not illustrated) which emits high-frequency microwaves to the cooking chamber 11; a high voltage transformer 13 which supplies high voltage to the magnetron; an electric resistance heater 17 that is mounted on the upper porion of the cooking chamber 11 to cook foodstuffs in the cooking chamber 11 by radiant heat and convective heat; and a food tray 12 which is provided on the inner bottom of the cooking chamber, and is designed to be elevated and to be rotated about a vertical axis. In addition, a door (not illustrated) is installed on the front side of the cooking chamber 11, to open/close the cooking chamber, a cooling fan for cooling the above components is installed to the back side of the electrical component compartment 14. A terminal is formed at an end of the heater 17 so that power is supplied to the heater 17. The heater can be rotated between horizontal and vertical states. In this case, a position of the heater can be changed by the user, and various cooking operations are possible according to the position of the heater.

The above microwave oven also includes a shaft 31 having an upper end connected with the bottom of the tray 12 and a lower end extending downward to the outside of the cooking chamber 11; an elevation guide member 34 positioned under the shaft 31 to elevate the shaft 31; an elevating motor 33 that reciprocates the elevation guide member right and left; a motor 32 that rotates the shaft 31 by means of a gear 32*a*; and a weight sensing mechanism 35 that is provided under the elevation guide member 34 to measure the weight of a foodstuff on the tray 12.

The following description relates to the operation of the above microwave oven.

If microwaves of about 2,450 MHz in frequency are applied to the food, molecules of the food contained in a metallic case are motivated by microwave energy so the food emits heat. A microwave oven is an oven that uses microwave heating for fast cooking of meat and other foods.

When the magnetron emits microwaves of about 2,450 MHz to the metallic cabinet 10, molecules of the food are each positively and negatively charged. That is, one side of each food molecule is negatively charged by the positive electrons of the electric field created by the microwaves, and the other side of each food molecule is positively charged by the negative electrons of the electric field. Since the electric field's polarity is changed about 2.4 billion, 5 thousand times per second, the food's molecules collide with each other to thereby create friction heat so that the food is heated up.

Assuming that the weight sensing mechanism 45 determines that food has been placed on the tray, the oven can perform fast cooking of foods by microwave energy or heat, while rotating the tray or moving it up or down. The tray is elevated to a predetermined height simultaneously with a starting operation. When the elevation of the tray 12 is completed, the tray is rotated and foodstuff on the tray 12 is cooked by the microwave energy generated from the magnetron.

In the meantime, if a use selects a desired cooking mode and operates a key input panel (not illustrated), the magnetron and heater are controlled according to the selected cooking mode and cooking time. If the user selects cooking modes such as a warm mode, a thaw mode and the like, the magnetron is operated. If the user selects a grill mode, barbecue mode or pizza-baking mode, the heater is operated. In addition, the cooking can be achieved by using the magnetron and the heater simultaneously.

The food cooked in a conventional microwave oven may be fully cooked before the set cooking time has elapsed, especially when the user cooks a small quantity of food. As a result, the food can be excessively boiled or burned. Also, in that case, the magnetron and the heater will have been driven for an unnecessarily long time, thereby wasting energy.

SUMMARY OF THE INVENTION

Accordingly, the present invention is directed to a method for controlling a driving of a microwave oven that substantially obviates one or more of the above-described problems.

It is an objective of the present invention to provide a method for controlling a driving of a microwave oven which senses a weight of the food when cooking, and drives a magnetron and a heater for a maximum allowable time, when the food weight is below a reference weight value.

In order to achieve this object and others, a method for controlling a driving of the microwave oven, includes the steps of:

sensing a weight of the food;

comparing the sensed food weight with a reference weight; and setting a maximum cooking time when the food weight is less than the reference weight, the maximum cooking time being the same, regardless of the amount by which the food weight is below the reference weight.

BRIEF DESCRIPTION OF THE DRAWINGS

The preferred embodiment of the present invention will now be described more specifically with reference to the attached drawings, wherein.

DETAILED DESCRIPTION OF THE PREFERRED EMBODIMENT

The preferred embodiment of the present invention will become apparent from a study of the following detailed description, when viewed in light of the accompanying drawings.

Figure 1:
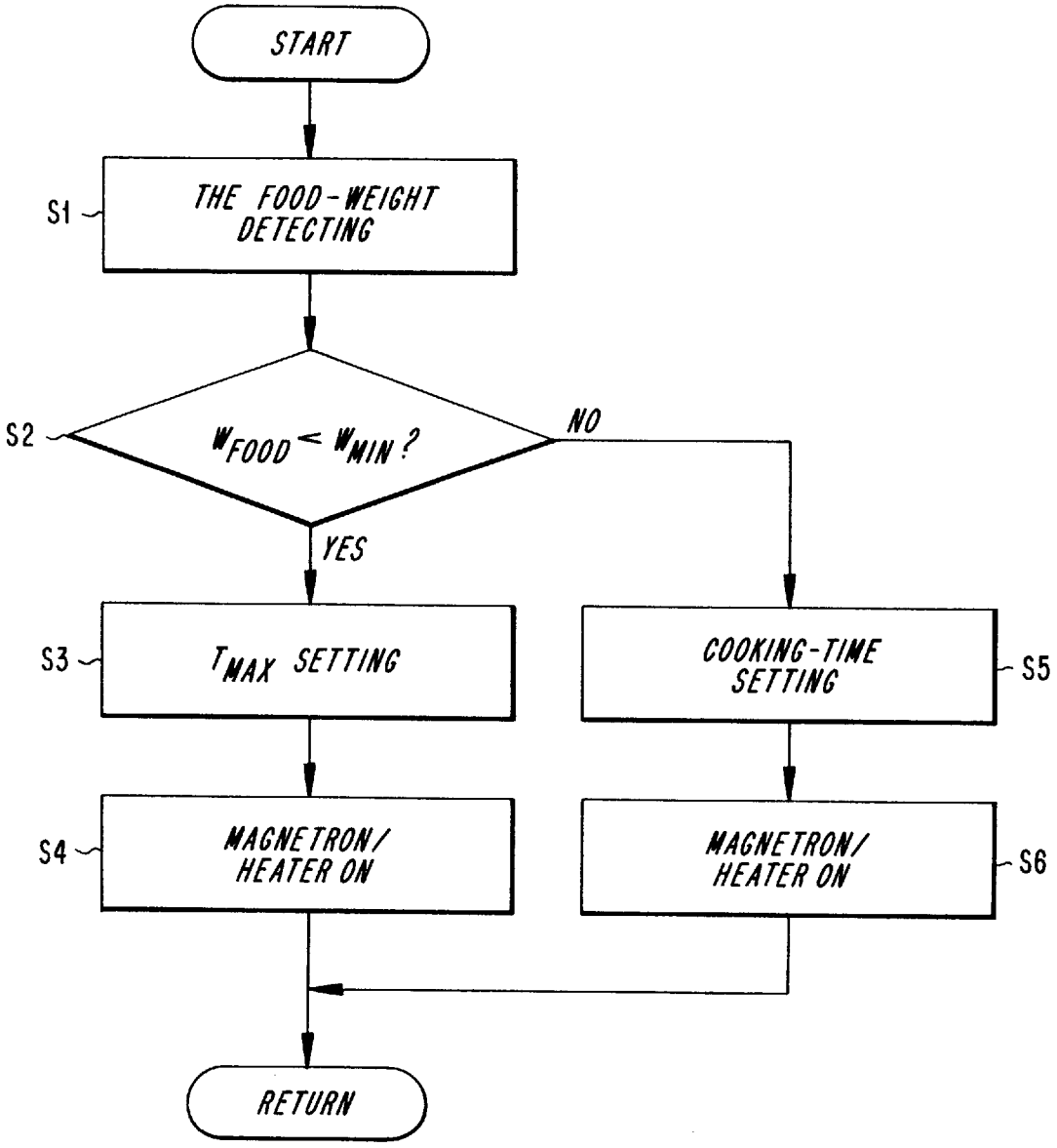
FIG. 1 is a flow chart of a method of driving a microwave oven in accordance with the present invention.
Figure 2:
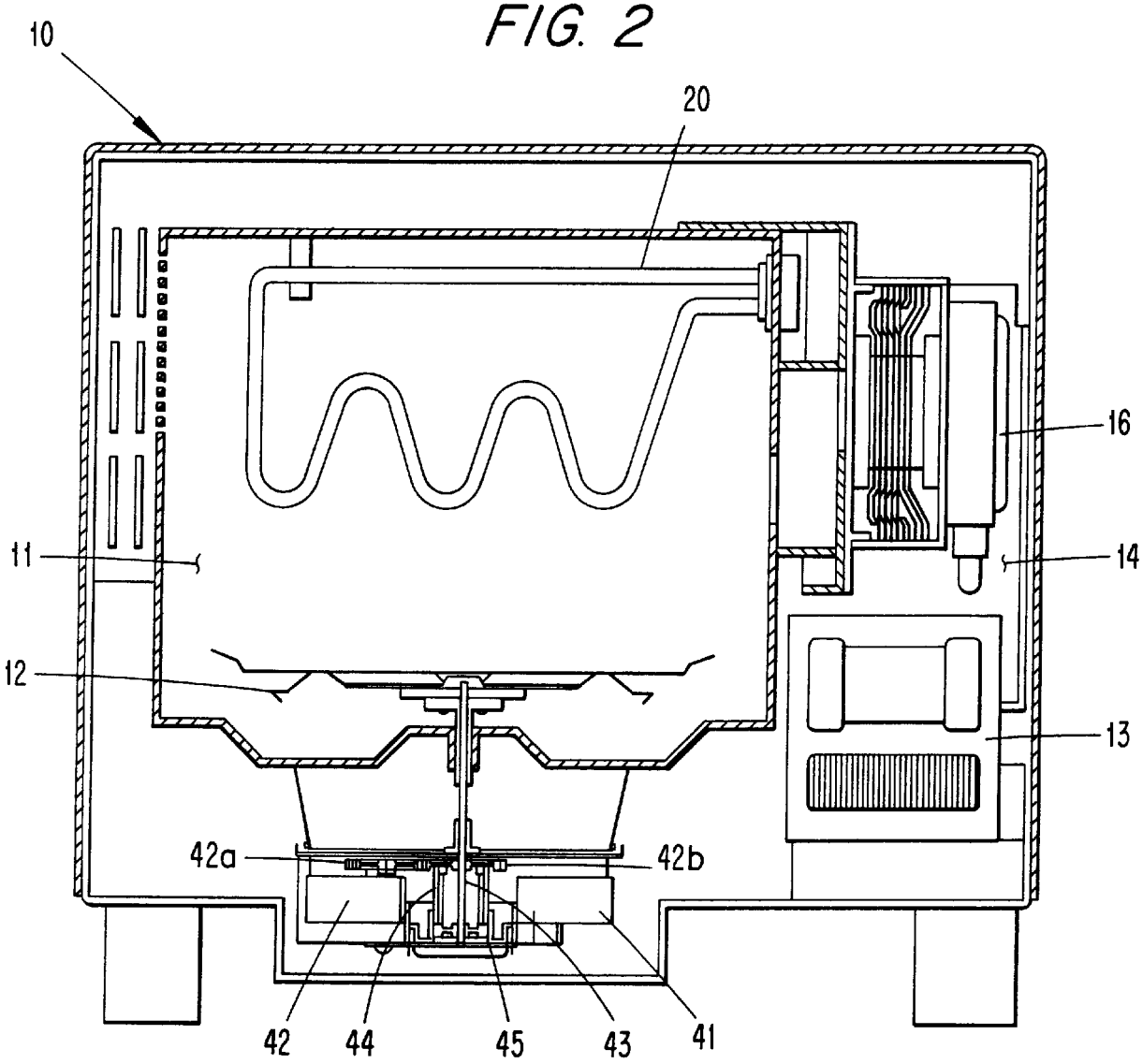
FIG. 2 is a vertical sectional view of a microwave oven in accordance with a preferred embodiment of the present invention.

As shown in FIG. 2, a microwave oven includes a cooking chamber 11, a magnetron 16 which is provided in an electrical component compartment 14 to emit high-frequency microwaves to the cooking chamber 11, and a high voltage generator 13 which supplies high voltage to the magnetron 16. An electric resistance heater 20 is mounted on the upper portion of the cooking chamber 11 to cook foodstuffs in the cooking chamber 11 by radiant heat and convective heat. A food tray 12 is provided near the floor of the cooking chamber 11, and designed to be rotated about a vertical axis and to be elevated.

The above microwave oven also includes a shaft 43 having an upper end connected with the bottom of the tray 12 and a lower end extending downward to the outside of the cooking chamber 11. A motor 42 delivers torque to a rotary gear 42*a* which meshes with a gear 42*b* so as to rotate the shaft 43 and the tray 12. The shaft 43 is connected by a spline to the gear 42*b* to enable the shaft to move vertically with respect to the gear 42*b*. An elevation mechanism 44, actuated by a motor 41, is positioned under the shaft 43 for moving the shaft 43 and tray 12 up and down.

The elevation mechanism 44 preferably corresponds to that disclosed in commonly assigned, copending application U.S. application Ser. No. 08/664,665, filed Jun. 17, 1996, and now U.S. Pat. No. 5,672,291 the disclosure of which is incorporated herein by reference.

A conventional weight sensing mechanism 45 is provided for weighing the tray 12 and any food disposed thereon, when the tray is in its lowermost position, i.e., when the shaft 43 rests upon the weighing mechanism. By subtracting the weight of the tray and shaft from the weight sensed by the mechanism 45, the food weight can be obtained. Any suitable weight sensing mechanism 45 can be utilized, such as that disclosed in the aforementioned U.S. Pat. No. 4,615,405 and Japanese Laid-Open Publication 96-320123.

The following description relates to the control circuit of the microwave oven in accordance with the present invention.

Figure 3:
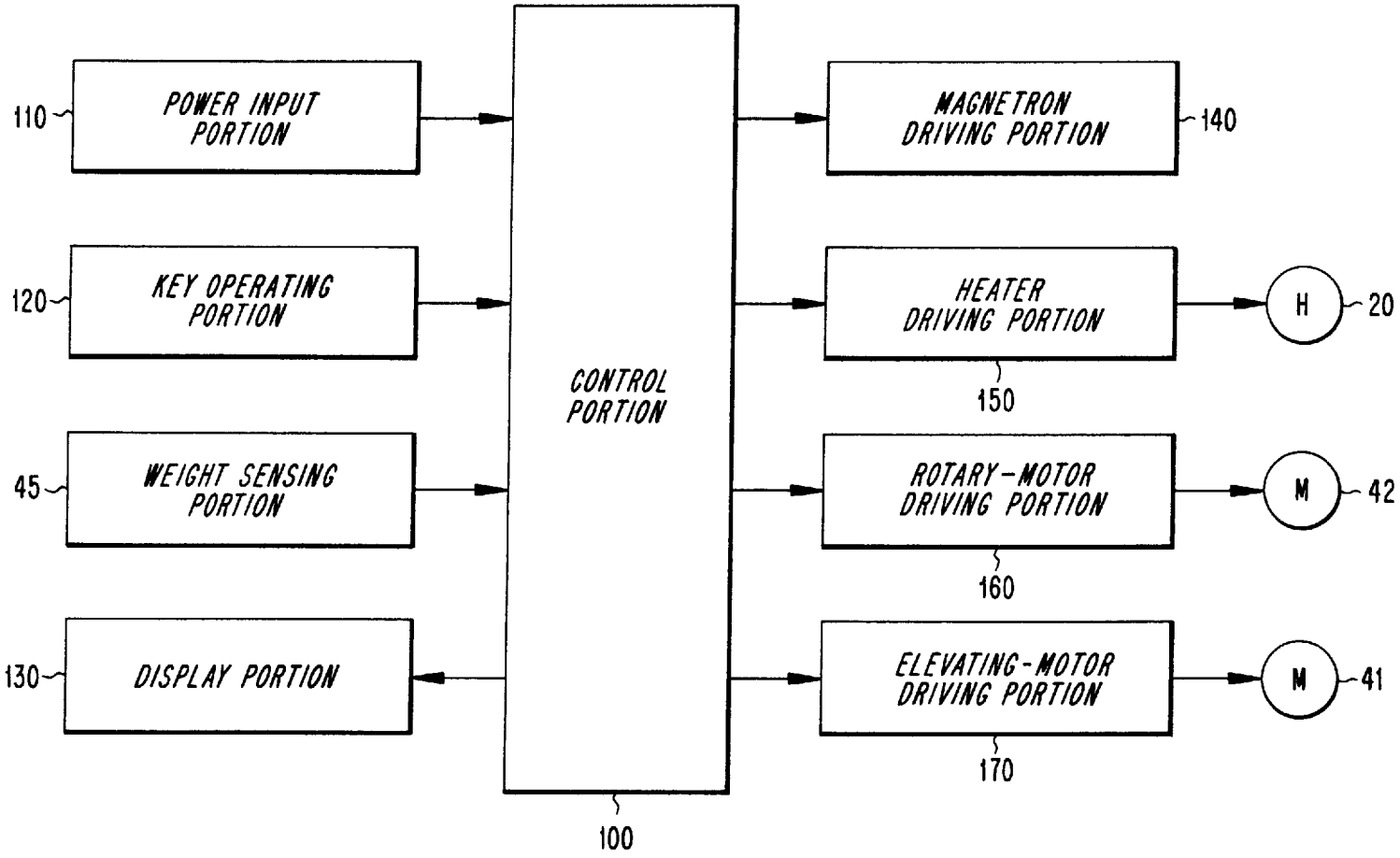
FIG. 3 is a block diagram of a control circuit of the microwave oven in accordance with a preferred embodiment of the present invention.

Referring to FIG. 3, the main control circuit of the microwave oven includes a control portion 100 which controls the overall operation of the microwave oven from the start of cooking to the completion of the cooking, a power input portion 110 which furnishes the control portion 100 with the proper electric voltages and currents for its operation, a manually operable key operating portion 120 used to input to the oven a desired cooking mode and cooking time. A display portion 130 displays various messages and cooking conditions during operation, and a heater driving portion 150 controls the microwave oven's heater 20.

Figure 4:
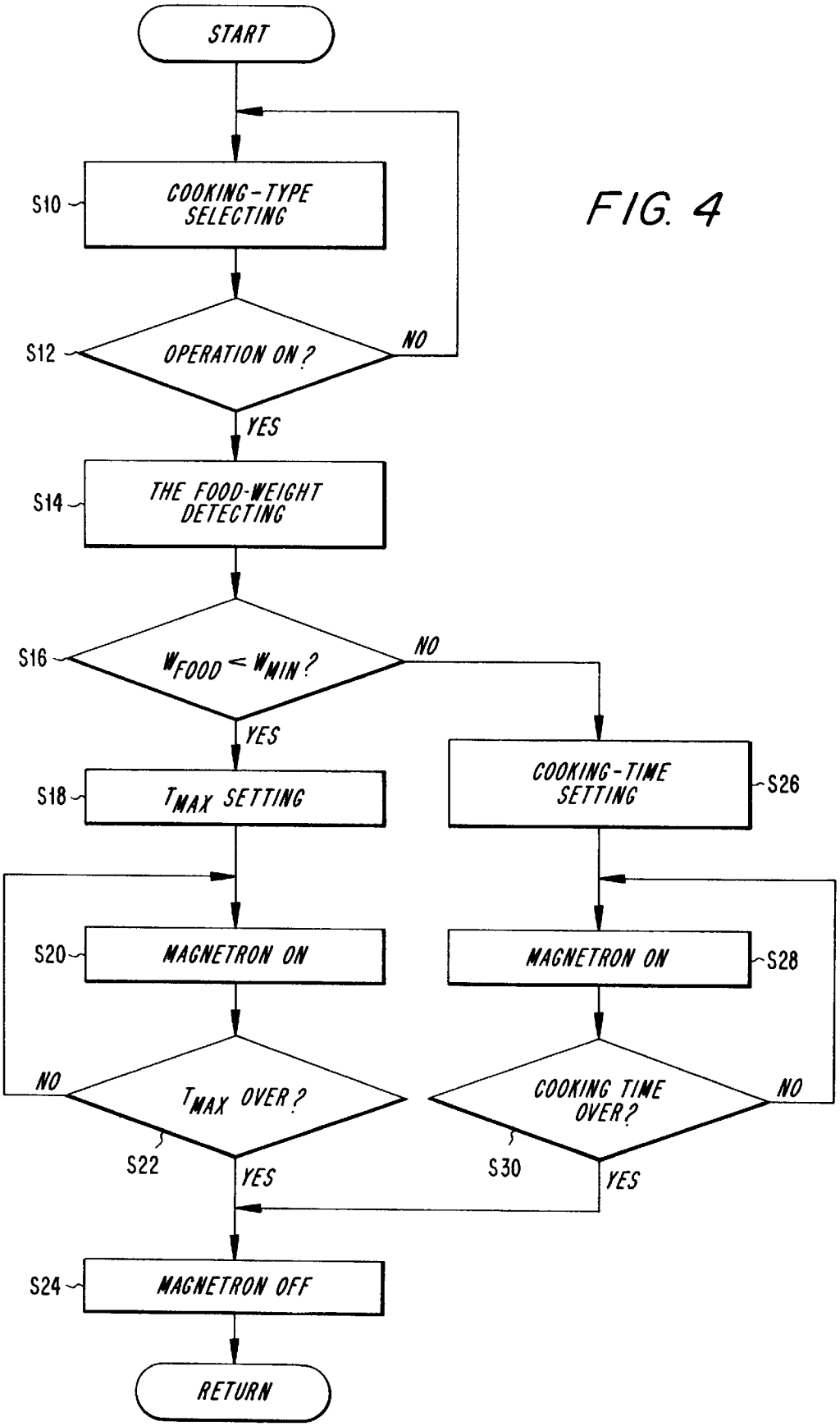
FIG. 4 is a flow chart of a method of driving a microwave oven in accordance with a preferred embodiment of the present invention.
Figure 5:
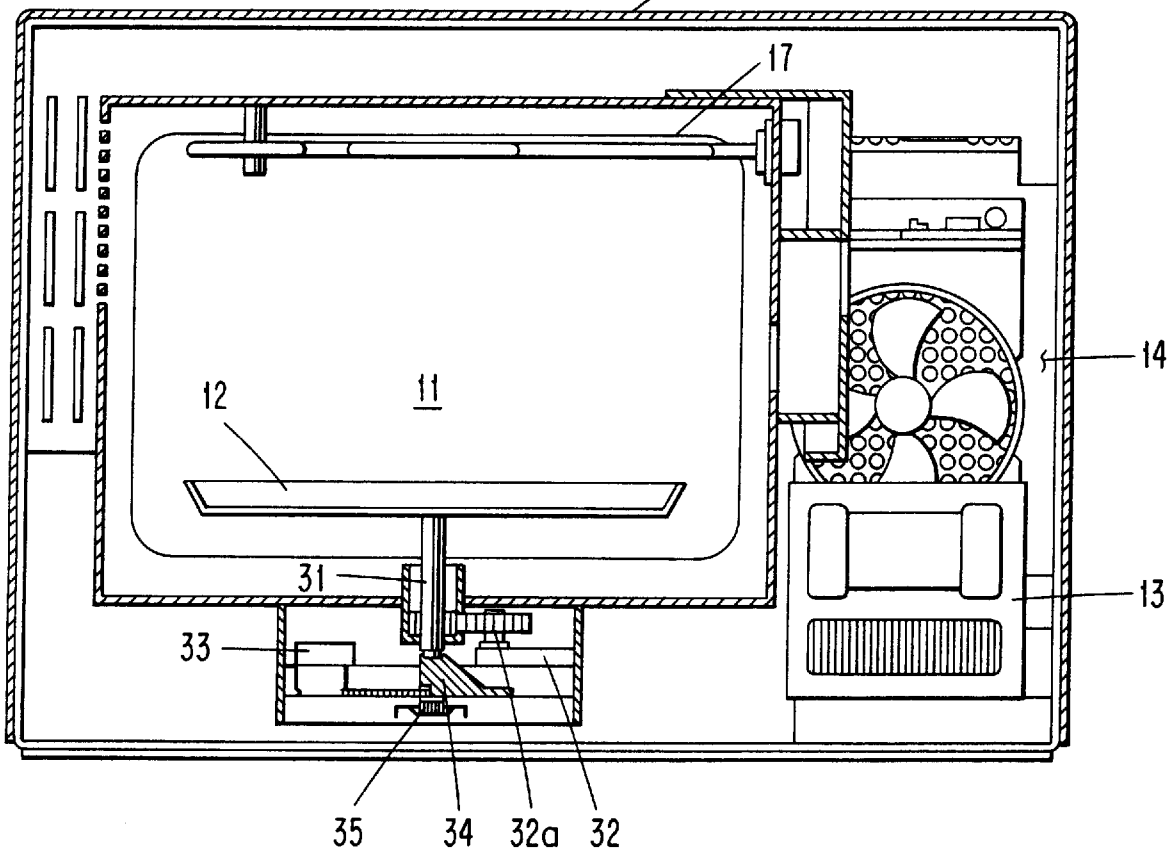
FIG. 5 (PRIOR ART)
FIG. 5 depicts a vertical sectional view of a conventional microwave oven.

As shown in FIG. 4, the method for driving the microwave oven which cooks food in a cooking chamber by using a high frequency from the magnetron and/or heat from the electric heater, includes, in general, the steps of:

putting food on the tray in the cooking chamber, and determining a desired cooking mode (step S10);

determining whether a cooking start command has been input to initiate operation of the oven (step S12);

sensing the weight $W_{FOOD}$ of the food (step S14);

comparing the weight $W_{FOOD}$ with a predetermined minimum weight $W_{MIN}$ (step S16);

determining a maximum allowable time $T_{MAX}$ for driving the magnetron, when the weight $W_{FOOD}$ is less than the minimum weight $W_{MIN}$ (step S18), the time$_{MAX}$ T being the same, regardless of the actual weight of the food;

driving the magnetron (step S20);

counting a time period during which the magnetron is driven during step S20;

determining whether the counted time period is longer than the maximum allowable time $T_{MAX}$, and returning to the magnetron driving step S20 when the counted time is not longer than the maximum allowable time $T_{MAX}$ (step S22);

determining a cooking time for driving the magnetron, when the food weight $W_{FOOD}$ is not less than the minimum weight $W_{MIN}$ in the food weight comparing step S14 (step S26), the cooking time being a function of the selected cooking mode and/or weight of the food;

driving the magnetron (step S28);

counting a time period during which the magnetron is driven during step S28; and determining whether the counted time period is longer than the predetermined cooking time established in step S26, and returning to the magnetron driving step S28 when the counted time is not longer than such predetermined cooking time (step S30).

Finally, when the magnetron driving time reaches the maximum allowable time $T_{MAX}$ of step S18 or the cooking time of step S26, the magnetron is shut off.

The method for controlling the microwave oven will be now described with reference to FIG. 4 in greater detail.

In a microwave oven which cooks food of a cooking chamber by using a high frequency from a magnetron and/or heat from an electric heater, the user puts the food on the tray 12 and selects a desired cooking mode (step S10).

The controller determines whether a cooking start command has been input (step S12), and then senses the weight $W_{FOOD}$ of the food (step S14).

For example, when the cooking start command is input after selecting a microwave cooking mode, the rotary motor 42 is driven, whereupon the shaft 43 connected with the tray 12 rotates, so that the tray 12 is also rotated. At this point, the elevating motor 41 is not driven, so the shaft 43 rotates at its lowest position.

Accordingly, the rotating shaft 43 presses against the weight sensing portion 45 by a force dependent upon the weight of the tray 12, shaft 43, and food. A known output waveform emitted when there is no food on the tray 12 is compared with an output waveform detected when there is food on the tray 12, thereby enabling the food weight $W_{FOOD}$ to be calculated.

Then, the microwave oven compares the food weight $W_{FOOD}$ with a predetermined minimum weight $W_{MIN}$ (step S16), and determines a maximum allowable time $T_{MAX}$ for driving the magnetron when the weight $W_{FOOD}$ is less than the minimum weight $W_{MIN}$ (step S18). The time $T_{MAX}$ is the same regardless of how much the food weight is below $W_{MIN}$.

For example, suppose that the minimum weight $W_{MIN}$ is set to be 300 grams including a weight of a container in which the food is disposed.

To prevent overheating of the food and wasted power-consumption, if the food weight $W_{FOOD}$ is lower than 300 grams, e.g., 250 grams, in the food weight comparing step S16, the maximum allowable time $T_{MAX}$ is set. If the food weight were 200 grams instead of 250 grams, $T_{MAX}$ would still be the same.

Next, the magnetron is driven and the controller counts a time during which the magnetron has been driven (step S20), determines whether the counted time is longer than the maximum allowable time $T_{MAX}$ and returns to the magnetron driving step S20 when the counted time is not longer than the maximum allowable time $T_{MAX}$ (step S22).

When the magnetron driving time reaches the maximum allowable time $T_{MAX}$ the microwave oven stops the magnetron (step S24). If the user had manually selected a cooking time which was less than $T_{MAX}$ then the cooking would have terminated at the end of such manually set time period. If the manually selected time was greater than $T_{MAX}$ the cooking would have terminated when $T_{MAX}$ was reached.

The microwave oven determines a cooking time for driving the magnetron, when the food weight $W_{FOOD}$ is not less than the minimum weight $W_{MIN}$ in the food weight comparing step S14 (step S26). That is, when the food weight $W_{FOOD}$ is beyond the minimum weight $W_{MIN}$, the cooking time is calculated by a program already stored in the control portion according to a cooking mode, or by the sensed food weight in an automatic cooking case. Alternatively, the user can determine a cooking time by way of a manual selection.

Then, the microwave oven counts a time wherein the magnetron is driven (step S28), determines whether the counted time is longer than the predetermined cooking time, and returns to the magnetron driving step S28 when the counted time is not longer than the predetermined cooking time (step S30).

Finally, when the magnetron driving time reaches the cooking time, the microwave oven stops the magnetron (step S24).

During any of the cooking operations, the tray 12 can be elevated by the elevation mechanism 44.

As described above, the present invention drives a magnetron and heater no longer than a maximum allowable time when the food quantity is less then a minimum weight value, irrespective of any user-selected cooking time. Accordingly, the present invention prevents the overcooking of small food portions, and also prevents the magnetron and/or heater from being driven for an unnecessarily long time, thereby reducing power-consumption.

It will be apparent to those skilled in the art that various modifications and variations can be made in the present invention without departing from the spirit or scope of the invention. Thus, it is intended that the present invention cover modifications and variations of this invention which come within the scope of the appended claims and their equivalents.

What is claimed is:

1. A method of controlling a cooking time period for cooking food in a cooking chamber of a microwave oven to prevent overcooking of small food portions, the method comprising the steps of:

A) sensing a weight of the food;

B) comparing the food weight with a reference weight;

C) automatically determining a maximum cooking time period when the food weight is less than the reference weight, the automatically determined maximum cooking time period being the same regardless of the amount by which the food weight is below the reference weight;

D) manually inputting a manually selected cooking time period when the food weight is less than the reference weight;

E) initiating a cooking operation;

F) terminating the cooking operation at the end of the automatically determined maximum cooking time period, when the manually selected cooking time period exceeds the automatically determined maximum cooking time period; and G) terminating the cooking operation at the end of the manually selected cooking time period when the manually selected cooking time period is less than the automatically determined maximum cooking time.

2. The method according to claim 1 further including the steps of selecting a cooking mode; automatically setting a cooking time when the food weight is greater than the reference weight, which cooking time is determined as a function of at least one of the selected cooking mode and food weight; and cooking the food for such time period.

3. The method according to claim 1 further including the step of manually inputting a cooking time, and cooking the food for the manually input cooking time when the food weight is greater than the reference weight.

4. The method according to claim 1 wherein step A includes obtaining a first weight value representative of the total weight of the food and a food support device.

* * * * *